US007053833B2

(12) United States Patent
Hsu et al.

(10) Patent No.: US 7,053,833 B2
(45) Date of Patent: May 30, 2006

(54) PATCH ANTENNA UTILIZING A POLYMER DIELECTRIC LAYER

(75) Inventors: Chieh-Sheng Hsu, Taipei Hsien (TW); Chang-Hsiu Huang, Taipei Hsien (TW); Cheng-Geng Jan, Taipei Hsien (TW)

(73) Assignee: Wistron NeWeb Corporation, Hsi-Chih (TW)

( * ) Notice: Subject to any disclaimer, the term of this patent is extended or adjusted under 35 U.S.C. 154(b) by 0 days.

(21) Appl. No.: 10/710,580

(22) Filed: Jul. 22, 2004

(65) Prior Publication Data

US 2006/0017616 A1 Jan. 26, 2006

(51) Int. Cl.
*H01Q 1/38* (2006.01)

(52) U.S. Cl. ..... 343/700 MS; 428/209

(58) Field of Classification Search ..... 343/700 MS, 343/846, 705, 702, 785; 428/209
See application file for complete search history.

(56) References Cited

U.S. PATENT DOCUMENTS 5,315,753 A * 5/1994 Jensen et al. ..... 29/600
5,969,681 A * 10/1999 O'Neill, Jr. ..... 343/700 MS
6,271,792 B1 * 8/2001 Sletten et al. ..... 343/700 MS
6,492,947 B1 * 12/2002 Anderson ..... 343/700 MS
6,512,487 B1 * 1/2003 Taylor et al. ..... 343/795
6,703,114 B1 * 3/2004 Guiles et al. ..... 428/209
2002/0050951 A1 * 5/2002 Durham ..... 343/700 MS
2002/0163468 A1 * 11/2002 Anderson ..... 343/700 MS
2004/0150561 A1 * 8/2004 Tillery et al. ..... 343/700 MS
2004/0196190 A1 * 10/2004 Mendolia et al. .... 343/700 MS
2004/0212536 A1 * 10/2004 Mori et al. ..... 343/700 MS

* cited by examiner

*Primary Examiner*—Don Wong
*Assistant Examiner*—Hung Tran Vy
(74) *Attorney, Agent, or Firm*—Winston Hsu

(57) ABSTRACT

A patch antenna includes a metallic ground plate, a metallic radiating element, and a polymer plastic dielectric layer sandwiched between the radiating element and the ground plate. Top and bottom surfaces of the dielectric layer are primed with polymeric surfactants to provide better adhesive characteristics at low temperatures. The radiating element is fixed to the dielectric layer by compressing an adhesive layer applied to the radiating element between the radiating element and the priming layer applied to the top surface of the dielectric layer. The ground plate is fixed to the dielectric layer by compressing another adhesive layer applied to the ground plate between the ground plate and the priming layer applied to the bottom surface of the dielectric layer. A low noise amplifier may be integrated with the antenna by sharing the common ground plate and connecting the amplifier's signal trace to the radiating element via a conductor pin.

20 Claims, 7 Drawing Sheets

PATCH ANTENNA UTILIZING A POLYMER DIELECTRIC LAYER

BACKGROUND OF INVENTION

1. Field of the Invention

This invention relates generally to antennas, and more specifically to the structure and assembly of a patch antenna utilizing a polymer plastic dielectric layer providing a reasonable sized antenna at a substantially reduced cost.

2. Description of the Prior Art

A conventional patch antenna in its simplest form is made of a rectangular conductive radiating element overlapping and approximately parallel with a conductive ground plate. A dielectric layer, or element, separates the radiating element from the ground plate. A basic structure of a typical patch antenna is shown in FIG. 1. The patch antenna 10 is assembled with the dielectric layer 15 sandwiched between the radiating element 12 and the ground plate 17.

As is well known in the art, many of the properties of a patch antenna, specifically including size and cost, depend to a great degree upon the composition of the dielectric layer. Besides the cost of the dielectric layer itself, the dielectric constant of the dielectric layer directly affects the dimensions of the distributed circuit components. At one extreme, air can be considered the dielectric layer. Air is obviously quite inexpensive, however air's low dielectric constant of 1.0 requires a relatively large-sized radiating element, which is not desirable in today's world of increasing miniaturization. Near the opposite extreme of commonly used dielectric layers, ceramic's dielectric constant of 7.0–10.0 permits a relatively small-sized radiating element, with a downside of a markedly increased cost.

Wide varieties of other materials are available for use as a dielectric layer. Some other common dielectric layer examples include foam and high frequency printed circuit boards (PCB). The use of a PCB as the dielectric layer permits a relatively small sized antenna, but is quite expensive. Foam is quite inexpensive, but requires a much larger antenna due to its low dielectric constant. Additionally, extreme changes in temperature make some materials unacceptable because temperature changes may break or alter bonding between the relative components or damage the assembled antenna. Thus, manufacture, assembly, and reliability considerations frequently far outweigh any potential saving achieved by the choice of an inexpensive material having a relatively high dielectric constant.

SUMMARY OF INVENTION

It is therefore a primary objective of the claimed invention to disclose a patch antenna that provides a reasonable sized antenna, at a reduced cost, and with increased durability and reliability.

A patch antenna according to the claimed invention includes a metallic radiating element, a metallic ground plate, and a polymer plastic dielectric layer sandwiched between the radiating element and the ground plate. Adhesive layers, possibly double side tape, respectively adhere the radiating element to one side of the dielectric layer and the ground plate to the other side of the dielectric layer.

Another patch antenna according to the claimed invention includes the metallic radiating element, the metallic ground plate, and the polymer plastic dielectric layer sandwiched between the radiating element and the ground plate. This antenna also has priming layers including polymeric surfactants applied to two sides of the dielectric layer and the adhesive layer compressed between the one of the priming layers and the radiating element and also between the other priming layer and the ground plate. A low noise amplifier may be integrated with the antenna by electrically connecting their ground plates together and connecting the amplifier's signal trace to the radiating element via a conductor pin.

A claimed method for constructing a patch antenna includes applying adhesive layers to an appropriate side of both the radiating element and the ground plate. Top and bottom surfaces of the polymer plastic dielectric layer are primed with polymeric surfactants. The radiating element is fixed to the dielectric layer by compressing the adhesive layer applied to the radiating element between the radiating element and the priming layer applied to the top surface of the dielectric layer. The ground plate is fixed to the dielectric layer by compressing the adhesive layer applied to the ground plate between the ground plate and the priming layer applied to the bottom surface of the dielectric layer. A low noise amplifier may be integrated with the antenna by sharing the common ground plate and connecting the amplifier's signal trace to the radiating element via a conductor pin.

The claimed invention uses a polymer plastic dielectric layer primed with an application of polymeric surfactants to provide improved adhesion of the adhesive layer to the dielectric layer after assembly. As a result, the present invention provides a reasonable sized antenna, at a reduced cost, and with increased reliability.

These and other objectives of the claimed invention will no doubt become obvious to those of ordinary skill in the art after reading the following detailed description of the embodiments, which are illustrated in the various figures and drawings.

DETAILED DESCRIPTION

Figure 1:
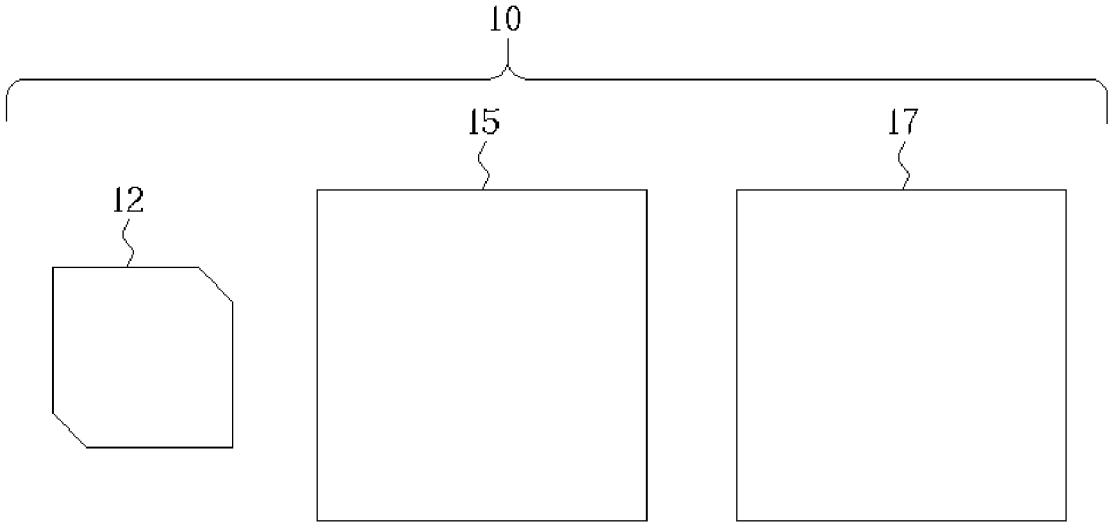
Fig. 1 Prior art
FIG. 1 is an illustration of the basic components of a prior art patch antenna.
Figure 2:
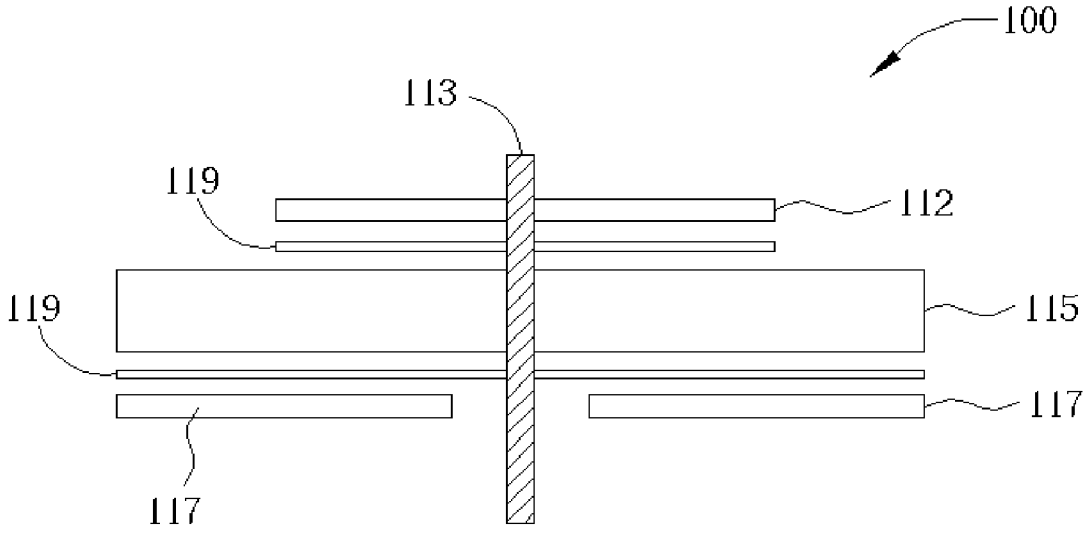
FIG. 2 is an illustration of a patch antenna according to the present invention.
Figure 3:
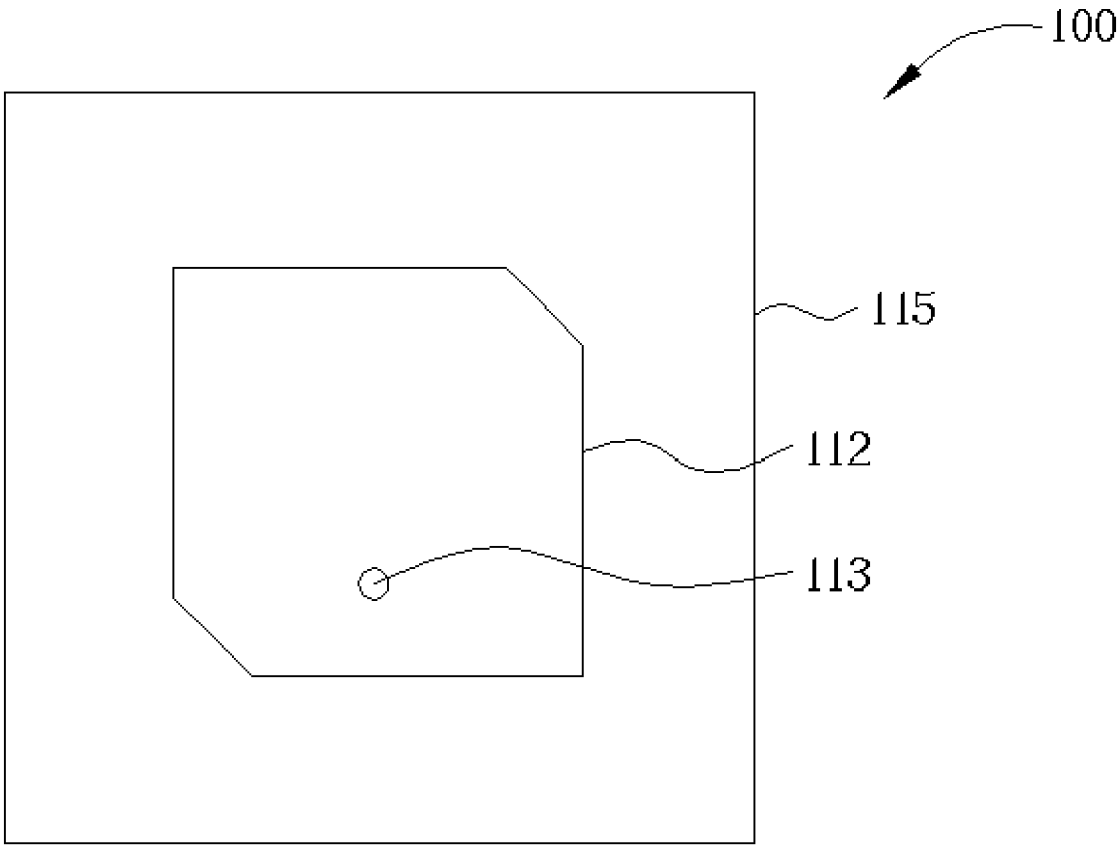
FIG. 3 is a top view of the patch antenna of FIG. 2.
Figure 4:
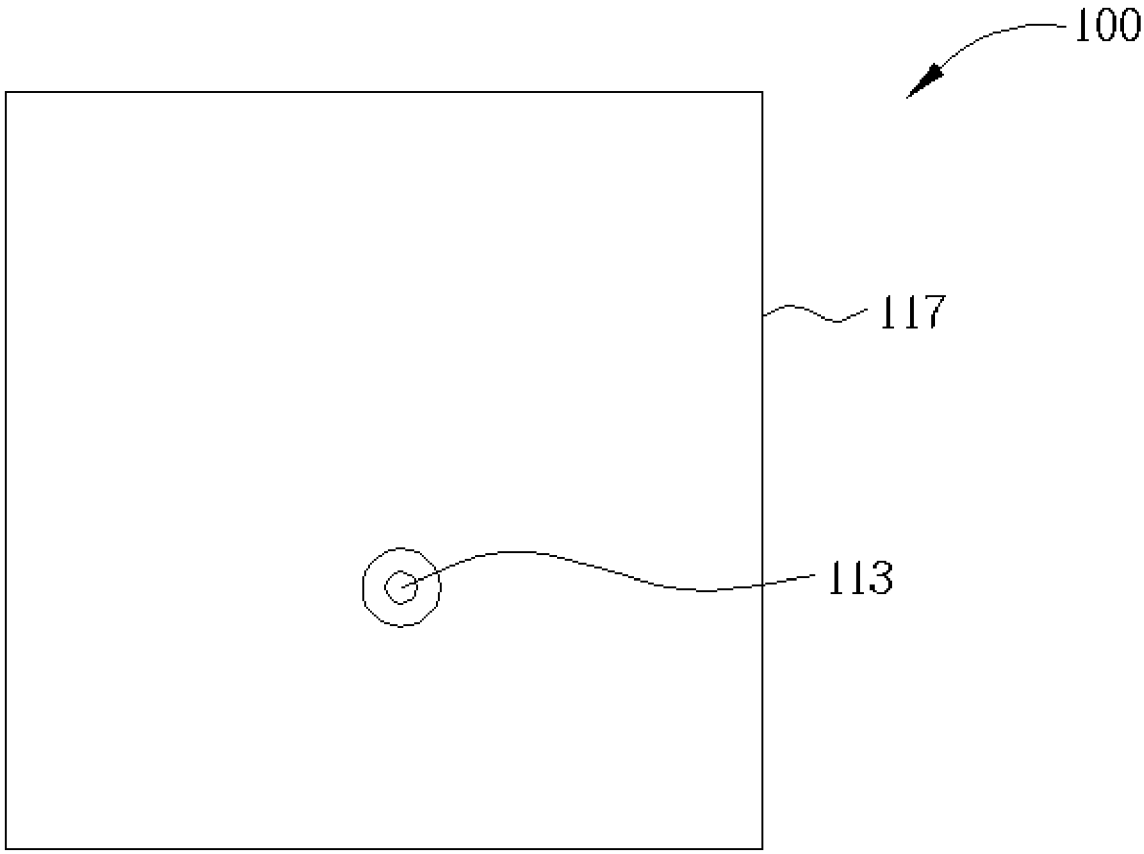
FIG. 4 is a bottom view of the patch antenna of FIG. 2.

A patch antenna 100 according to the present invention comprises a radiating element 112, a ground plate 117, and a dielectric layer 115 sandwiched between the radiating element 112 and the ground plate 117 as shown in FIGS. 2–4.

The radiating element 112 preferably comprises a flat metallic plate, sheet, or layer somewhat rectangular in shape. As is known in the art, it is possible to improve gain by altering the shape of the radiating element 112 and/or other elements of the antenna 100 and as such, the scope of the present invention is not intended to be limited to any specific shape of any of the antenna's components.

The ground plate 117 also preferably comprises a somewhat rectangular, flat metallic plate, sheet, or layer and is located so that planes formed by the radiating element 112 and the ground plate 117 are approximately parallel and overlapping as shown in FIGS. 2–4. The ground plate 117 may be attached to a printed circuit board or other substrate allowing thinning of the ground plate 117 without compromising strength and allowing easy integration of required circuitry into the patch antenna 100.

As previously stated, the choice of material for the dielectric layer 115 has a marked effect on the size, efficiency, durability, and cost of the antenna 100. According to the present invention, efficiency and durability can be maximized while minimizing cost in a reasonable sized patch antenna 100 by utilizing a polymer plastic as the dielectric layer 115. Forms of polymer plastic considered suitable include but are not limited to Polyethylene (PE), Polypropylene (PP), Polystyrene (PS), Polyisobutylene (PIB), Polybutylene (PB), polybutadiene (BR), Teflon, Acrylonitrile/Butadiene/Styrene (ABS), Acrylonitrile/Ethylene-Propylenediene/Styrene (AES), Acrylonitrile/Styrene/Acrylate (ASA), Polyurethane (PU), and Polycarbonate (PC). Although nearly any polymer plastic may be suitable for use as a dielectric layer 115 in the present invention, a polyolefin such as PE is preferred due to its low cost, relatively high dielectric constant (2.2–2.4 in pure form), and a relatively low dielectric loss such that the antenna has a higher efficiency as a result of design considerations.

Historically polymer plastics have been shunned as a dielectric layer 115 in antennas. The petroleum stock utilized to manufacture polymer plastics as well as manufacturing techniques and processes generally produce a very smooth, somewhat oily surface making it difficult if not impossible to find cost effective ways to durably adhere the metallic radiating element 112 and ground plate 117 to the respective surfaces of the polymer plastic. Simply gluing metal to polymer plastic generally fails to produce a durable bond. Even if screws are utilized to fix the assemblies, the screws will affect the performance of the antenna and the effect must be taken into account in the course of design. The screws complicate the design and increase the cost.

The present invention overcomes this drawback through the application of special adhesive layers 119 between the radiating element 112 and the dielectric layer 115 and between the ground plate 117 and the dielectric layer 115. Although another embodiment of the present invention may utilize different adhesive layers, it is preferred that the special adhesive layers 119 comprise double sided tape, which provides firm adhesion, very low cost, and simple assembly. It is not important to the invention whether the adhesive layers 119 are respectively applied to the dielectric layer 115 or the metallic layers 112, 117 first. What is important is that the adhesive layers 119 form a tight bond firmly holding the radiating element 112 to a top surface of the dielectric layer 115 and the ground plate 117 to a bottom surface of the dielectric layer 115.

As shown in FIGS. 2–4, during assembly, a conductor pin 113 is attached to the radiating element 112 and extends through holes in the adhesive layers 119, the dielectric layer 115, and the ground plate 117. Whether or not the conductor pin 113 extends through the radiating element 112 is subject to design considerations, but may make assembly easier. Soldering makes the attachment of the conductor pin 113 to the radiating element 112 inexpensive and practical. Once the cited components 112, 113, 115, 117, and 119 have been assembled as shown in FIGS. 2–4, additional pressure may be applied to compress and tightly adhere together the respective components of the antenna 100.

Although the antenna 100 provides reasonable durability for most applications and environments, tests have indicated that unusually cold environments (generally, subfreezing temperatures) substantially reduce the strength of the adhesive bond formed by the adhesive layers 119 and allow the antenna 100 to come apart if bumped forcefully enough. When separation does occur, one side of one of the adhesive layers 119 generally separates from the polymer plastic dielectric layer 115 due to the inability of the adhesive layer 119 to maintain a tight bond with the smooth, oily surface of the dielectric layer at low temperatures. A solution to this potential problem is disclosed in FIG. 5, which illustrates a second major embodiment of the present invention.

Figure 5:
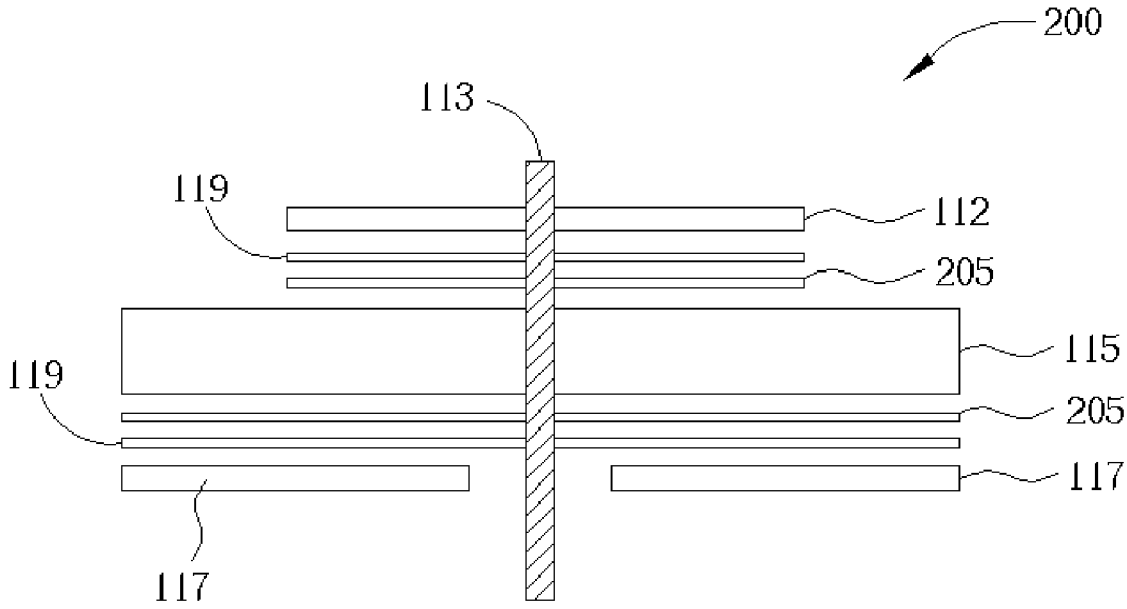
FIG. 5 is an illustration of another patch antenna according to the present invention.

The patch antenna 200 shown in FIG. 5 comprises the same radiating element 112, adhesive layers 119, dielectric layer 115, ground plate 117, and conductor pin 113 as does the antenna 100 of FIGS. 2–4. Functionality of the correspondingly numbered components and assembly of the patch antenna 200 is substantially the same as for the patch antenna 100. The obvious difference from the antenna 100 is that the antenna 200 further comprises a priming layer 205 respectively between the dielectric layer 115 and each adhesive layer 119.

The priming layers 205 preferably are a form of a polymeric surfactant applied to the top and the bottom surfaces of the dielectric layer 115 before the adhesive layers 119 are adhered to the primed top and bottom surfaces of the dielectric layer 115. The polymeric surfactants priming layers 205 effectively roughen and prepare the surfaces of the dielectric layer 115 for better adhesion to the adhesive layers 119 in cold temperature environments as well as in what are commonly considered normal operating conditions. Any method of application may be acceptable, but applying the priming layers 205 onto the top and the bottom surfaces of the dielectric layer 115 by brush or a spraying process the yields the best results.

Figure 6:
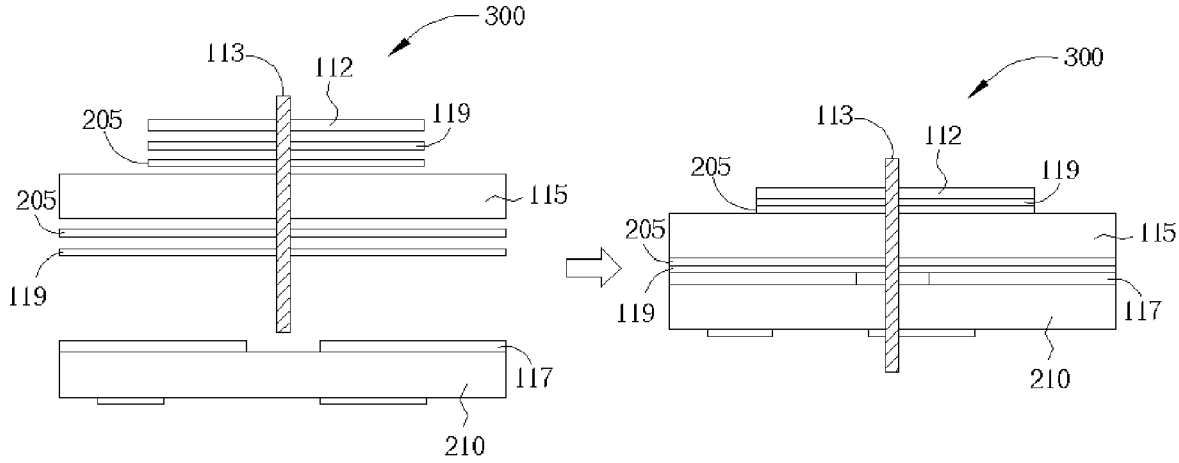
FIG. 6 is an illustration of another patch antenna according to the present invention.

Turning now to FIG. 6, another embodiment of the present invention is disclosed. The patch antenna 300 comprises the same radiating element 112, adhesive layers 119, dielectric layer 115, ground plate 117, conductor pin 113, and priming layers 205 as does the antenna 200 of FIG. 5. Functionality of the correspondingly numbered components and assembly of the patch antenna 300 is substantially the same as for the patch antenna 200. However, the patch antenna 300 further enjoys the addition of a low noise amplifier 210 integrated with the antenna 300 by means of sharing a common ground plate 117 and the amplifier's 210 signal trace is connecting to the radiating element via the conductor pin 113. The low noise amplifier 210 is utilized to amplify signals sent to or from the patch antenna 300. FIG. 6 includes side views of the antenna 300 in both an expanded and in an assembled perspective to permit easy understanding of the claimed structure.

Figure 7:
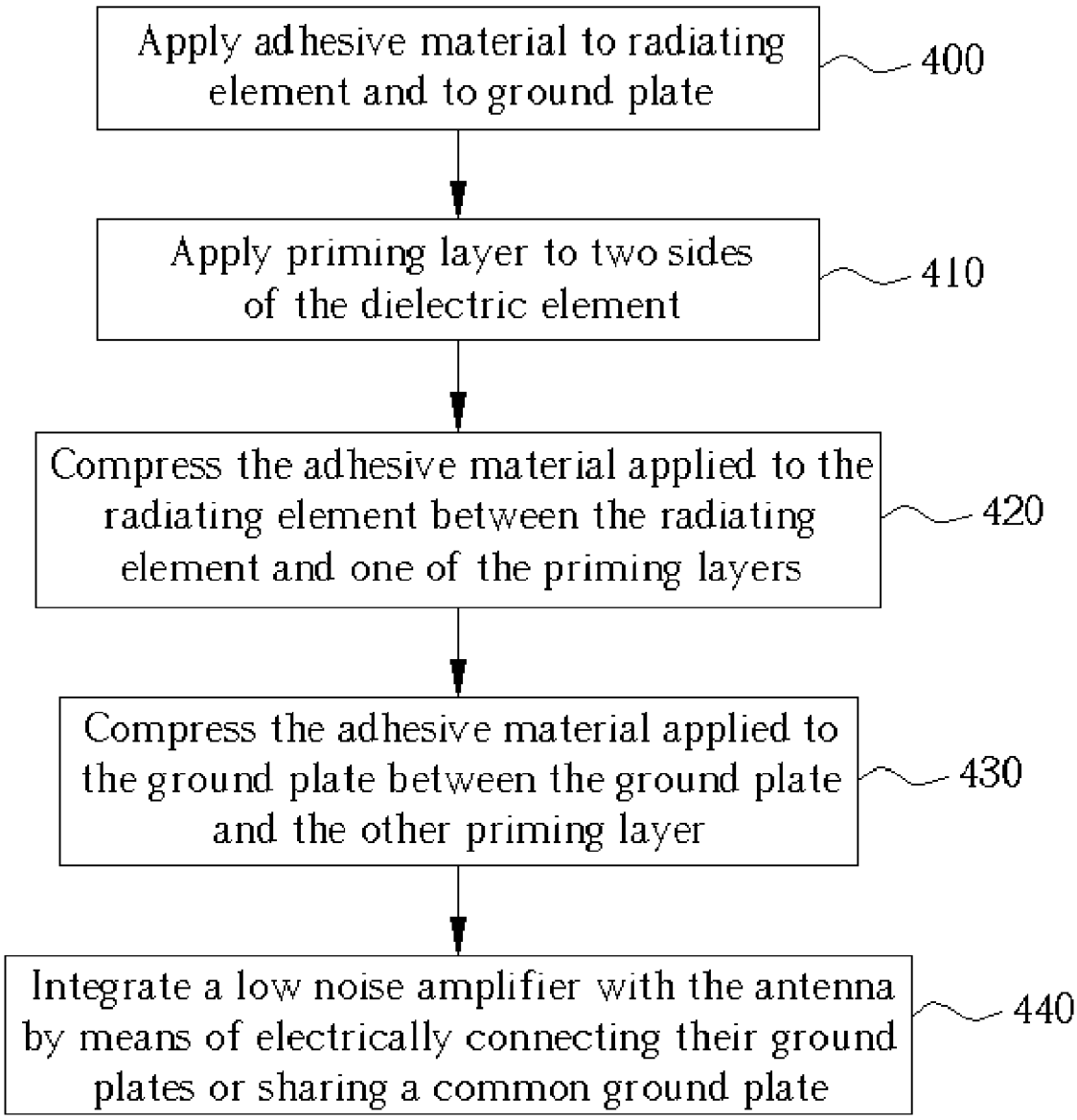
FIG. 7 is a flow chart of assembly of a patch antenna according to the present invention.

Please refer now to FIG. 7, which is a flow chart directing assembly of the present invention. Obviously, the specific order of steps during assembly may be rearranged without departing from the spirit of the invention.

Step 400: The adhesive layer is applied to both the radiating element and the ground plate. Normally, the adhesive material is double sided tape, preferably but not necessarily cellophane double sided tape.

Step 410: The priming layers are applied to the top and bottom surfaces of the dielectric layer. Normally, the step includes applying polymeric surfactants to the two cited surfaces of a polymer plastic, possibly PE.

Step 420: The radiating element is fixed to the dielectric layer by compressing the adhesive layer applied to the radiating element between the radiating element and the priming layer applied to the top surface of the dielectric layer.

Step 430: The ground plate is fixed to the dielectric layer by compressing the adhesive layer applied to the ground plate between the ground plate and the priming layer applied to the bottom surface of the dielectric layer.

Step 440: The conductor pin is electrically connected from the radiating element to the low noise amplifier, passing through openings in the adhesive layers, the priming layers, the dielectric layer, and the ground plate.

It is to be understood that strictly speaking, the integration of the low noise amplifier into the patch antenna of the present invention is preferable but may not be absolutely necessary for proper functionality of the antenna, depending upon signal strength and other components utilized in the operation of the antenna.

In contrast to patch antennas of the prior art, the present invention uses a polymer plastic primed with the application of polymeric surfactants to provide improved adhesion of the respective components after assembly. The present invention antenna is assembled utilizing priming layers comprising the polymeric surfactants applied to two sides of the dielectric layer and an adhesive layer, possibly double sided tape, located between the priming layers and the radiating element and the ground plate respectively. A low noise amplifier may be integrated with the antenna by connecting their ground plates together and electrically connecting the amplifier's signal trace to the radiating element via a conductor pin. As a result, the present invention provides a reasonable sized antenna, at a reduced cost, and with increased durability over the prior art.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A patch antenna comprising:

a dielectric layer having a first surface and a second surface;

a first priming layer contacting the first surface;

a second priming layer contacting the second surface;

a first adhesive layer on the first priming layer;

a second adhesive layer on the second priming layer;

a radiating element on the first adhesive layer; and a ground plate on the second adhesive layer.

2. The patch antenna of claim 1 further comprising a low noise amplifier integrated with the patch antenna by sharing a common ground plate or by electrically connecting the ground plates and a signal conductor pin from the amplifier to the radiating element.

3. The patch antenna of claim 1 wherein the dielectric layer comprises a material selected from a group consisting of Polyethylene (PE), Polypropylene (PP), Polystyrene (PS), Polyisobutylene (PIB), Polybutylene (PB), Polybutadiene (BR), Teflon, Acrylonitrile/Butadiene/Styrene (ABS), Acrylonitrile/Ethylene-Propylenediene/Styrene (AES), Acrylonitrile/Styrene/Acrylate (ASA), Polyurethane (PU), and Polycarbonate (PC).

4. The patch antenna of claim 1 wherein the dielectric layer substantially is polymer plastic.

5. The patch antenna of claim 4 wherein the first priming layer comprises a polymeric surfactant.

6. The patch antenna of claim 4 wherein the first adhesive layer comprises double sided tape.

7. The patch antenna of claim 4 wherein the first and second priming layers comprise a polymeric surfactant and the first and second adhesive layers comprise double sided tape.

8. The patch antenna of claim 7 wherein the polymer plastic is a polyolefin.

9. A method of antenna assembly, the antenna comprising a radiating element, a dielectric layer, and a ground plate, the method comprising:

applying a first adhesive layer to radiating element;

applying a second adhesive layer to the ground plate;

respectively applying a priming layer to a first surface and a second surface of the dielectric layer;

fixing the radiating element to the dielectric layer by compressing first adhesive layer between the radiating element and the priming layer applied to the first surface of the dielectric layer, and fixing the ground plate to the dielectric layer by compressing the second adhesive layer between the ground plate and the priming layer applied to the second surface of the dielectric layer.

10. The method of claim 9 further comprising integrating an amplifier into the antenna with a common ground plate or electrically connected ground plates and a conductor pin electrically connected from the radiating element to the amplifier, the conductor pin passing through openings in the adhesive layers, the priming layers, the dielectric layer, and the ground plate.

11. The method of claim 9 wherein the first adhesive layer is double sided tape.

12. The method of claim 9 wherein the priming layer comprises polymeric surfactants.

13. The method of claim 9 wherein the dielectric layer comprises a material selected from a group consisting of Polyethylene (PE), Polypropylene (PP), Polystyrene (PS), Polyisobutylene (PIB), Polybutylene (PB), Polybutadiene (BR), Teflon, Acrylonitrile/Butadiene/Styrene (ABS), Acrylonitrile/Ethylene-Propylenediene/Styrene (AES), Acrylonitrile/Styrene/Acrylate (ASA), Polyurethane (PU), and Polycarbonate (PC).

14. The method of claim 9 wherein the dielectric layer substantially is polymer plastic.

15. The method of claim 9 wherein the priming layer comprises a polymeric surfactant and the first and second adhesive layers comprise double sided tape.

16. The method of claim 15 wherein the dielectric layer substantially is a polyolefin.

17. An antenna comprising:

a polymer plastic dielectric layer having a first surface and a second surface;

a first priming layer comprising a polymeric surfactant contacting the first surface;

a second priming layer comprising a polymeric surfactant contacting the second surface;

a first adhesive layer comprising double sided tape fixed to the first priming layer; a second adhesive layer comprising double sided tape fixed to the second priming layer;

a radiating element fixed to the first adhesive layer; and a ground plate fixed to the second adhesive layer.

18. The antenna of claim 17 further comprising a low noise amplifier and a signal conductor pin electrically connecting the low noise amplifier to the radiating element.

19. The patch antenna of claim 17 wherein the dielectric layer comprises a material selected from a group consisting of Polyethylene (PE), Polypropylene (PP), Polystyrene (PS), Polyisobutylene (PIB), Polybutylene (PB), Polybutadiene (BR), Teflon, Acrylonitrile/Butadiene/Styrene (ABS), Acrylonitrile/Ethylene-Propylenediene/Styrene (AES), Acrylonitrile/Styrene/Acrylate (ASA), Polyurethane (PU), and Polycarbonate (PC).

20. The patch antenna of claim 17 wherein the polymer plastic dielectric layer substantially comprises a polyolefin.

* * * * *